US006229261B1

(12) United States Patent
Kim

(10) Patent No.: US 6,229,261 B1
(45) Date of Patent: May 8, 2001

(54) PLASMA DISPLAY DEVICE

(75) Inventor: Nac-koo Kim, Cheonan (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/281,433

(22) Filed: Mar. 30, 1999

(30) Foreign Application Priority Data

Mar. 31, 1998 (KR) ..... 98-11340

(51) Int. Cl.[7] ..... H01J 17/49

(52) U.S. Cl. ..... 313/586; 313/583; 313/584; 313/585; 313/587

(58) Field of Search ..... 313/583, 584, 313/585, 586, 587

(56) References Cited

U.S. PATENT DOCUMENTS 5,742,122 * 4/1998 Amemiya et al. ..... 313/587 X
6,097,149 * 8/2000 Mijaji et al. ..... 313/582

* cited by examiner

*Primary Examiner*—Ashok Patel
(74) *Attorney, Agent, or Firm*—Leydig, Voit & Mayer, Ltd.

(57) ABSTRACT

A plasma display device including a substrate, partitions on the upper surface of the substrate, and an address electrode parallel to the partitions on the substrate, located between the partitions for inducing an initial discharge, and divided into at least three sections lengthwise.

13 Claims, 2 Drawing Sheets

PLASMA DISPLAY DEVICE

BACKGROUND OF THE INVENTION

1. Field of the Invention

The present invention relates to a plasma display device, and more particularly, to a plasma display device having an improved address electrode structure.

2. Description of the Related Art

In a plasma display device, a glow discharge occurs by applying a predetermined voltage between two electrodes and a fluorescent layer is excited by ultraviolet light generated by the glow discharge, thereby forming a picture image.

Plasma display devices are divided into direct current (DC) plasma display devices and alternating current (AC) plasma display devices according to their operating principles. Also, depending on the electrode structure, the plasma display device has two or three electrodes for discharge. In the DC plasma display device, an auxiliary anode is additively installed for inducing an auxiliary discharge. In the AC plasma display device, an address electrode is introduced for separately providing a selective discharge and a sustaining discharge to enhance addressing speed.

Also, the electrode structure of the AC plasma display device can be classified into an opposing electrode structure and a surface-discharge type electrode structure, according to the arrangement of discharge-inducing electrodes. In the former case, two discharge-inducing sustaining electrodes are disposed on a front substrate and a rear substrate, respectively, so that a discharge takes place in a direction perpendicular to the panel. In the latter case, two sustaining electrodes are disposed on a substrate so that a discharge takes place along the substrate.

FIG. 1 shows an example of a surface-discharge plasma display device. Referring to FIG. 1, a dielectric layer 13 having an address electrode 12 embedded therein is formed on the upper surface of a lower substrate 11, and a partition 14 having a predetermined pattern for defining a discharge space is formed on the upper surface of the dielectric layer 13. An upper substrate 15 is located above the partition 14 and a common electrode 16 and a scanning electrode 17, each having a predetermined pattern, are formed on the lower surface of the upper substrate 15 perpendicular to the address electrode 12. A bus electrode (not shown) for reducing electrode resistance may be formed in the common electrode 16 and the scanning electrode 17.

A dielectric layer 18 having the common electrode 16 and the scanning electrode 17 embedded therein is formed on the lower surface of the upper substrate 15, and a protective layer 19 made of MgO coats on the lower surface of the dielectric layer 18.

Also, a fluorescent layer 10 is formed on the upper surface of the dielectric layer 13 between neighboring partitions 14. A discharge gas fills the discharge space.

In operation the conventional plasma display device having the above structure, when a voltage is applied to the address electrode 12 and the common electrode 16, wall charges are accumulated by a trigger discharge. In such a state, a glow discharge occurs between the common electrode 16 and the scanning electrode 17, thereby producing light. Then, the fluorescent layer 10 is excited by ultraviolet light, thereby forming a picture image.

In the above-described plasma display device, since the address electrode 12 is formed in strips perpendicular to the scanning electrodes 17, the time necessary for addressing the address electrode 12 depends on the number of the scanning electrodes 17. Thus, the fewer the scanning electrodes there are, the longer the sustaining time is necessary.

An example of an address electrode which can reduce the sustaining time considering the above problem is shown in FIG. 2.

As shown in FIG. 2, an address electrode 12' disposed between neighboring partitions 14' and covered by a dielectric layer 13' is divided into two parts at the center of an effective screen of a plasma display device. However, even in the case of the address electrode being thus constructed, if there are many scanning electrodes, sufficient brightness cannot be attained.

SUMMARY OF THE INVENTION

To solve the above problems, it is an objective of the present invention to provide a plasma display device which can improve the brightness of a picture image by dividing address electrodes into a plurality of parts.

Accordingly, to achieve the above objective, there is provided a plasma display device including a substrate, partitions formed on the upper surface of the substrate, and an address electrode formed to be parallel to the partitions on the substrate between the partitions to induce an initial discharge and divided into at least three sections lengthwise.

According to another aspect of the present invention, there is provided a plasma display device including a substrate, a dielectric layer formed on the upper surface of the substrate, partitions formed on the dielectric layer, and an address electrode having a plurality of split electrodes spaced apart from one another to be parallel to the partitions in the dielectric layer between the partitions and conductive lead portions connected to the split electrodes.

Here, the conductive lead portions are formed between the partitions and the substrate.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
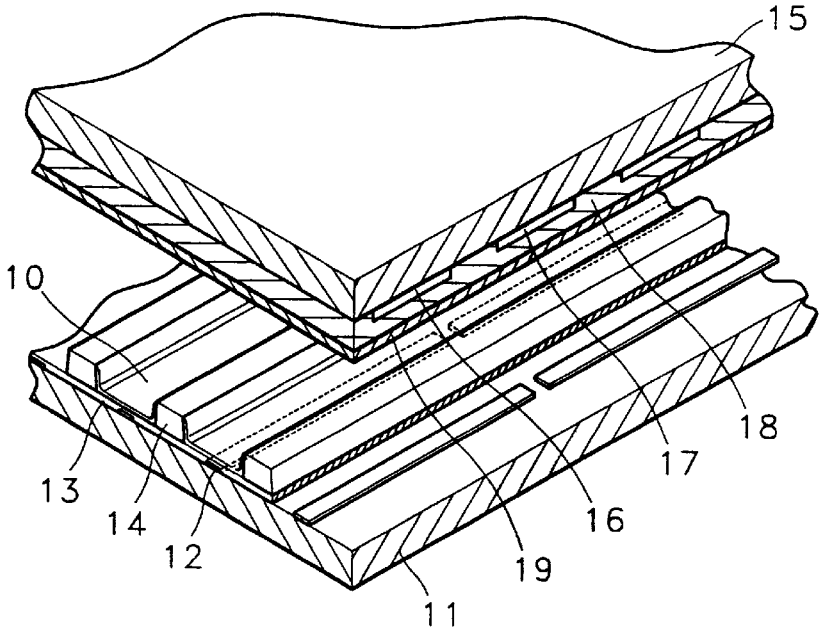
FIG. 1 (PRIOR ART)
FIG. 1 is an exploded perspective view illustrating a conventional plasma display device.
Figure 2:
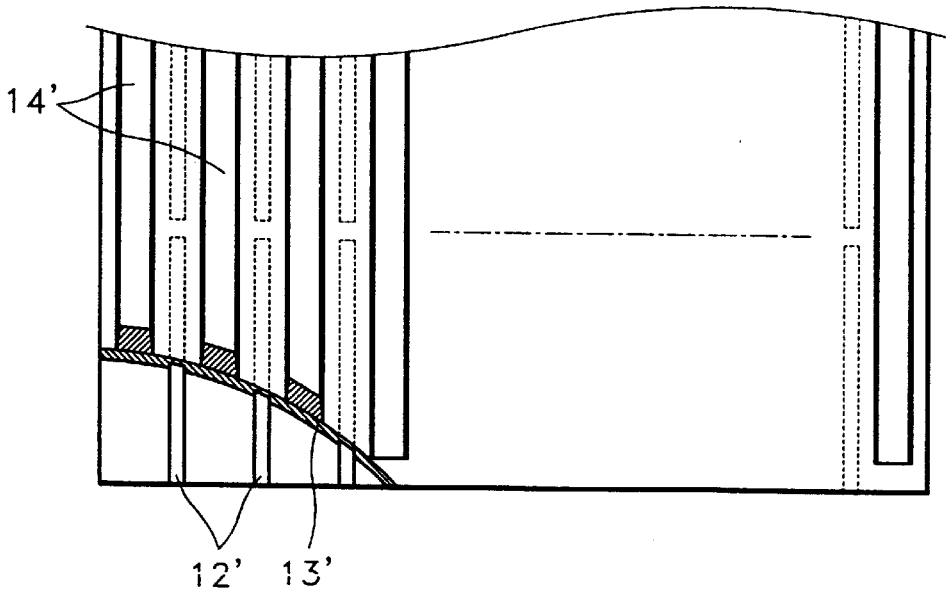
FIG. 2 (PRIOR ART)
FIG. 2 is a plan view of an address electrode and partitions shown in FIG. 1.
Figure 3:
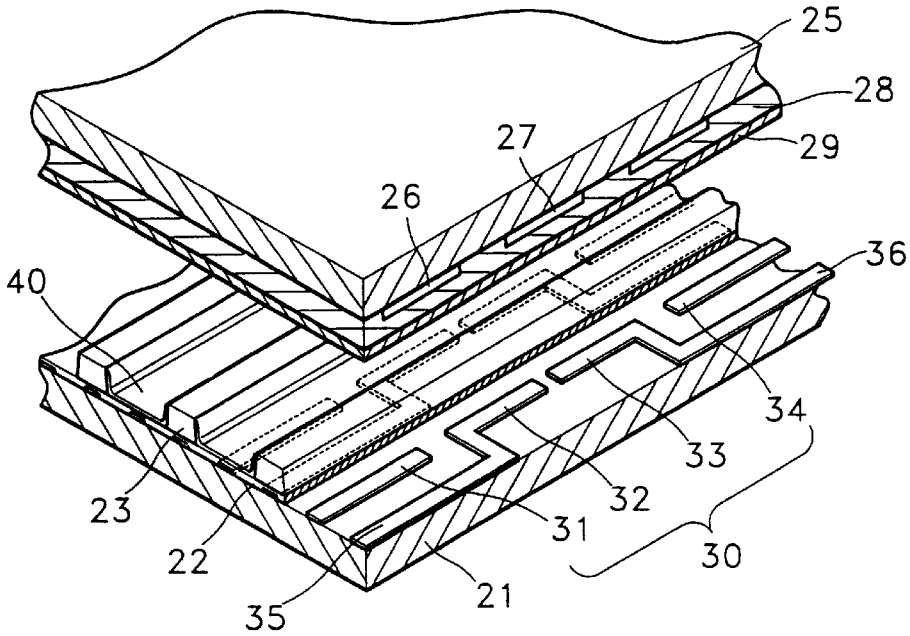
FIG. 3 is a partially exploded perspective view illustrating a plasma display device according to the present invention.
Figure 4:
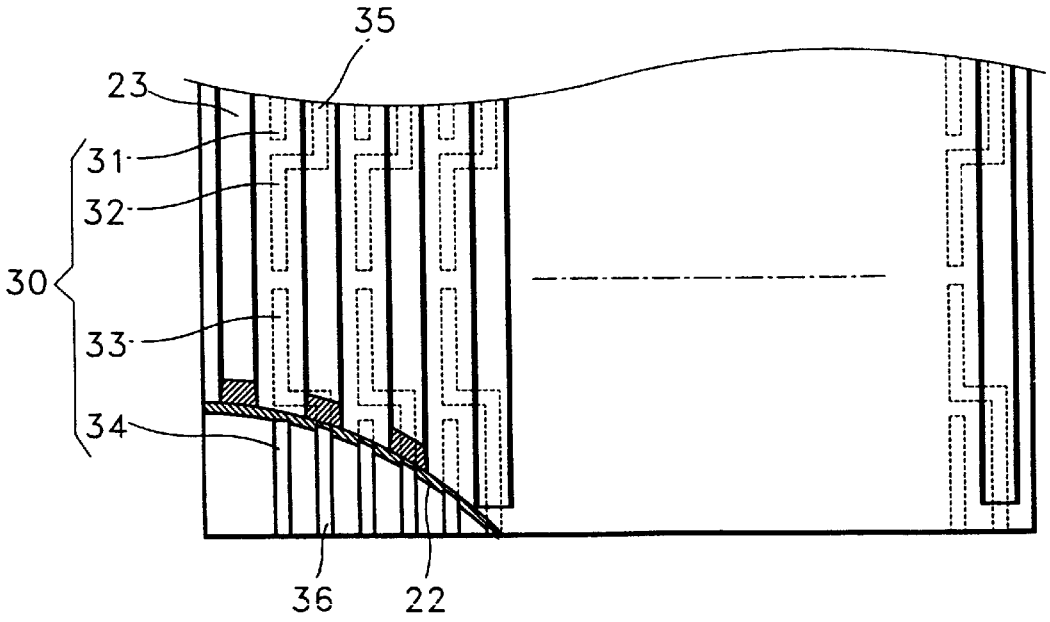
FIG. 4 is a plan view of an address electrode and partitions shown in FIG. 3.

FIGS. 3 and 4 show a plasma display device according to the present invention. Referring to the drawings, a dielectric layer 22 is located on the upper surface of a lower substrate 21, and partitions 23 having a predetermined pattern are located on the upper surface of the dielectric layer 22. The partitions are in parallel strips and have a striped pattern.

An address electrode 30 is located between the respective partitions 23 and buried by the dielectric layer 22. According to the present invention, the address electrode 30 includes at least three split electrodes parallel to the partitions 23.

FIG. 3 shows the address electrode 30 consisting of four split electrodes 31, 32, 33 and 34. The first and fourth split electrodes 31 and 34 are positioned at the edges of a lower substrate 21. The second and third split electrodes 32 and 33 are positioned between the first and fourth split electrodes 31 and 34, and connected to conductive lead portions 35 and 36 extending from the edges of the lower substrate 21, and a predetermined voltage is applied thereto. Here, the conductive lead portions 35 and 36 may be located between the dielectric layer 22 and the lower substrate 21 or between the partition 23 and the dielectric layer 22. Otherwise, the conductive lead portions 35 and 36 may be covered by the partitions 23. The conductive lead portions 35 and 36 are preferably a low-resistance metal.

Although the address electrode is constituted by four split electrodes in this embodiment, the invention is not limited thereto and the address electrode may include a plurality of split electrodes.

A transparent upper substrate 25 is positioned above the partitions 23 to define a discharge space together with the partitions 23. A common electrode 26 and a scanning electrode 27 are perpendicular to the address electrode 30 on the lower surface of the upper substrate 25 and are covered by the dielectric layer 28 on the lower surface of the upper substrate 25.

A fluorescent layer coats the discharge space defined by the partitions 23. Reference numeral 29 denotes a protective layer formed of MgO.

The driving method of the plasma display device according to the present invention is achieved by addressing driving and sustaining driving.

To perform the addressing driving, voltages are applied to the split electrodes 31, 32, 33 and 34 and the common electrode 26, corresponding to a pixel to be made to luminesce. Accordingly, a preliminary discharge takes place so that wall charges are accumulated within the discharge space. In such a state, sustaining driving is performed. That is to say, a predetermined voltage is applied to the common electrode 26 and the scanning electrode 27 to induce a glow discharge so that a fluorescent layer 40 is excited by ultraviolet rays generated during the glow discharge, thereby forming a picture image.

In driving the plasma display device according to the present invention, since the address electrode 30 is divided into a plurality of split electrodes 31, 32, 33 and 34, the number of scan electrodes 27 corresponding to the respective split electrodes is relatively decreased, thereby reducing the addressing time for the addressing discharge.

The result of an experiment carried out by the inventor of the present invention showed that while the ratio of an address driving time to a sustained driving time was 10 to 6 in the case of driving a plasma display device employing undivided address electrodes, for displaying an 8-bit 852× 480 gray-scale image using an address/display separation method (ADS) method, the ratio of an address driving time to a sustained driving time was 3 to 13 in the case of driving a plasma display device employing an electrode divided into four sections while having the same specification as the former case. That is to say, the brightness in the plasma display device according to the present invention increased by about 2.17 (13/6) times that of the conventional plasma display device.

As described above, in the plasma display device according to the present invention, since the address electrode is divided into at least three sections to simultaneously drive the split electrodes, the addressing time is reduced.

It is noted that the present invention is not limited to the preferred embodiment described above, and it is apparent that variations and modifications by, those skilled in the art can be effected within the spirit and scope of the present invention defined in the appended claims.

What is claimed is:

1. A plasma display device comprising:

a substrate;

partitions on an upper surface of the substrate; and an address electrode parallel to the partitions on the substrate and located between the partitions for inducing an initial discharge and divided into at least three sections along a length of the address electrode.

2. A plasma display device comprising:

a substrate;

a dielectric layer on an upper surface of the substrate;

partitions on the dielectric layer; and an address electrode having a plurality of split electrodes spaced apart from one another and parallel to the partitions located in the dielectric layer between the partitions, and conductive lead portions connected to the split electrodes.

3. The plasma display device as claimed in claim 2, wherein the conductive lead portions are located between the partitions and the substrate.

4. The plasma display device as claimed in claim 3, wherein the conductive lead portions are, covered by the dielectric layer.

5. The plasma display device as claimed in claim 2, wherein the conductive lead portions are covered by the partitions.

6. The plasma display device as claimed in claim 2, wherein the address electrode includes at least three split electrodes spaced apart from one another.

7. The plasma display device as claimed in claim 2, including a plurality of address electrodes, each address electrode having a plurality of split electrodes spaced apart from one another, wherein each address electrode is disposed between a respective pair of the partitions.

8. A plasma display device comprising:

a substrate;

parallel partitions on an upper surface of the substrate; and an address electrode parallel to the partitions and located on the substrate between a pair of the partitions for inducing an initial discharge, the address electrode being divided along a length of the address electrode into at least three spaced apart sections.

9. The plasma display device as claimed in claim 8, including a dielectric layer disposed between the partitions and the substrate, covering the address electrode.

10. The plasma display device as claimed in claim 8, including conductive lead portions connected to respective sections of the address electrode.

11. The plasma display device as claimed in claim 10, wherein the conductive lead portions are located between the partitions and the substrate.

12. The plasma display device as claimed in claim 8, including a plurality of the address electrodes, each address electrode being divided along its length into at least three sections, wherein each address electrode is disposed between a respective pair of the partitions.

13. The plasma display device as claimed in claim 8, wherein the address electrode includes four sections spaced apart along its length.

* * * * *